US009404260B2

(12) United States Patent
Leitch

(10) Patent No.: US 9,404,260 B2
(45) Date of Patent: Aug. 2, 2016

(54) ROOFING SHINGLE SYSTEM AND SHINGLES FOR USE THEREIN

(71) Applicant: BUILDING MATERIALS INVESTMENT CORP., Dallas, TX (US)

(72) Inventor: Olan Leitch, Bakersfield, CA (US)

(73) Assignee: Building Materials Investment Corporation, Dallas, TX (US)

( * ) Notice: Subject to any disclaimer, the term of this patent is extended or adjusted under 35 U.S.C. 154(b) by 34 days.

(21) Appl. No.: 14/597,915

(22) Filed: Jan. 15, 2015

(65) Prior Publication Data

US 2015/0128777 A1 May 14, 2015
US 2015/0308119 A2 Oct. 29, 2015

Related U.S. Application Data

(60) Division of application No. 13/531,340, filed on Jun. 22, 2012, now Pat. No. 8,978,332, which is a continuation-in-part of application No. 29/409,522, filed on Dec. 23, 2011, now Pat. No. Des. 670,407, and (Continued)

(51) Int. Cl.
*E04D 1/26* (2006.01)
*E04D 1/22* (2006.01)

(52) U.S. Cl.
CPC ... *E04D 1/26* (2013.01); *E04D 1/22* (2013.01); *Y10T 83/0524* (2015.04)

(58) Field of Classification Search
CPC ..... B32B 38/185
See application file for complete search history.

(56) References Cited

U.S. PATENT DOCUMENTS 1,243,064 A 10/1917 Heppes
1,345,627 A 7/1920 Overbury
1,688,917 A 10/1928 Busha
D76,843 S 11/1928 Topping
1,732,403 A 10/1929 Harris et al.
D81,768 S 8/1930 Topping
1,812,424 A * 6/1931 Wood ..... D06N 5/00 83/667
1,846,635 A 2/1932 Finley
1,863,178 A * 6/1932 Wood ..... D06N 5/00 52/524
1,868,751 A * 7/1932 Koch ..... E04D 1/26 118/301

(Continued)

OTHER PUBLICATIONS

International Search Report and Written Opinion issued in International Application No. PCT/US2012/043889 dated Sep. 13, 2012—2 pages.

*Primary Examiner* — Joshua J Michener
*Assistant Examiner* — Kyle Walraed-Sullivan
(74) *Attorney, Agent, or Firm* — Fitzpatrick, Cella, Harper & Scinto

(57) ABSTRACT

A roofing shingle is disclosed comprising a headlap portion with a non-straight longitudinal edge and a buttlap portion with a plurality of tabs with a non-straight longitudinal edge and spaced apart by openings, wherein the non-straight longitudinal edges do not shadow each other laterally across the shingle. A roofing system is disclosed wherein at least a portion of the headlap portion of such shingle from a subsequently installed course overlaps at least a portion of the headlap portion of a shingle from a previously installed course. The maximum headlap overlap dimension is beneath the subsequently installed shingle laterally proximate the openings in the buttlap portion of the subsequently installed shingle. A method for making the shingle is disclosed comprising cutting a sheet of roofing material longitudinally along non-straight lines wherein at least a portion of each formed shingle has a width of about twelve inches.

4 Claims, 5 Drawing Sheets

Related U.S. Application Data a continuation-in-part of application No. 29/409,523, filed on Dec. 23, 2011, now Pat. No. Des. 670,408, and a continuation-in-part of application No. 29/409,524, filed on Dec. 23, 2011, now Pat. No. Des. 670,825, and a continuation-in-part of application No. 29/409,527, filed on Dec. 23, 2011, now Pat. No. Des. 670,826, and a continuation-in-part of application No. 29/409,532, filed on Dec. 23, 2011, now Pat. No. Des. 670,827, and a continuation-in-part of application No. 29/409,533, filed on Dec. 23, 2011, now Pat. No. Des. 670,409.

(56) References Cited

U.S. PATENT DOCUMENTS

| | | | | | |
|---|---|---|---|---|---|
| D91,744 | S | | 3/1934 | Topping | |
| 1,975,487 | A | | 10/1934 | Topping | |
| 2,104,067 | A | | 1/1938 | Bailey | |
| 2,106,396 | A | | 1/1938 | Topping | |
| 2,199,760 | A | | 5/1940 | Schuetz | |
| 2,272,032 | A | | 2/1942 | Brown | |
| 4,274,243 | A | | 6/1981 | Corbin et al. | |
| 4,333,279 | A | | 6/1982 | Corbin et al. | |
| 4,399,186 | A | * | 8/1983 | Lauderback | 442/374 |
| D314,439 | S | | 2/1991 | Jenkins et al. | |
| D317,506 | S | | 6/1991 | Jenkins et al. | |
| 5,052,162 | A | * | 10/1991 | Bush et al. | 52/518 |
| D366,124 | S | | 1/1996 | Hannah et al. | |
| 5,666,776 | A | * | 9/1997 | Weaver et al. | 52/557 |
| 5,939,169 | A | | 8/1999 | Bondoc et al. | |
| 6,058,670 | A | | 5/2000 | Sieling et al. | |
| 6,185,471 | B1 | * | 2/2001 | Sturdivant | G06K 19/06018 30/152 |
| 6,220,329 | B1 | * | 4/2001 | King | B32B 3/02 144/13 |
| 6,334,923 | B1 | * | 1/2002 | Koschitzky | B32B 38/185 156/260 |
| 6,355,132 | B1 | * | 3/2002 | Becker et al. | 156/260 |
| 6,360,638 | B1 | * | 3/2002 | White | B65H 23/1886 83/13 |
| 6,360,678 | B1 | * | 3/2002 | Komatsu et al. | 110/342 |
| D484,992 | S | | 1/2004 | Rodrigues | |
| 6,679,308 | B2 | | 1/2004 | Becker et al. | |
| 6,698,151 | B2 | | 3/2004 | Elliott | |
| 6,748,714 | B2 | * | 6/2004 | Elliott | 52/555 |
| 7,687,106 | B2 | * | 3/2010 | Hong et al. | 427/212 |
| 7,690,169 | B2 | | 4/2010 | Saarenko et al. | |
| 2003/0163964 | A1 | * | 9/2003 | Elliott | E04D 1/26 52/314 |
| 2007/0017330 | A1 | * | 1/2007 | Freshwater et al. | 83/13 |
| 2007/0068108 | A1 | * | 3/2007 | Kiik et al. | 52/518 |
| 2007/0137131 | A1 | * | 6/2007 | Nagarajan et al. | 52/518 |
| 2009/0139175 | A1 | * | 6/2009 | Todd et al. | 52/557 |
| 2011/0005158 | A1 | * | 1/2011 | Kailey et al. | 52/518 |

* cited by examiner

ROOFING SHINGLE SYSTEM AND SHINGLES FOR USE THEREIN

RELATED APPLICATIONS

This application is a division of U.S. patent application Ser. No. 13/531,340, filed Jun. 22, 2012, entitled "Roofing Shingle System and Shingles for Use Therein." which is a continuation-in-part of design application Ser. No. 29/409,522, filed on Dec. 23, 2011, entitled "Shingle," now U.S. Design Pat. No. D670,407, and a continuation-in-part of design application Ser. No. 29/409,523, filed on Dec. 23, 2011, entitled "Shingle," now U.S. Design Pat. No. D670,408, and a continuation-in-part of design application Ser. No. 29/409,524, filed on Dec. 23, 2011, entitled "Shingle," now U.S. Design Pat. No. D670,825, and a continuation-in-part of design application Ser. No. 29/409,527, filed on Dec. 23, 2011, entitled "Shingle," now U.S. Design Pat. No. D670,826, and a continuation-in-part of design application Ser. No. 29/409,532, filed on Dec. 23, 2011, entitled "Shingle," now U.S. Design Pat. No. D670,827, and a continuation-in-part of design application Ser. No. 29/409,533, filed on Dec. 23, 2011, entitled "Shingle," now U.S. Design Pat. No. D670,409.

The disclosures of all of the aforementioned applications are incorporated herein by reference.

FIELD OF THE INVENTION

This invention relates to an improved roofing shingle and a roofing system that utilizes the shingles. In particular, the invention relates to the construction of roofing shingles featuring unique dimensions that minimize the amount of material required to make the shingles and a roofing system that utilizes the shingles.

BACKGROUND OF THE INVENTION

Roofing products are often divided into three broad groups: shingles, roll roofing, and underlayment. Shingles and roll roofing typically function as outer roof coverings designed to withstand exposure to weather and the elements. Typically, the underlayment is first laid on the roof deck, and then the outer roofing covering (e.g., shingles or roll roofing) is installed on top of the underlayment.

Asphalt shingles are the most commonly used roofing materials. Shingles and roll roofing generally contain the same basic components, which provide protection and long term wear associated with asphalt roofing products. These components include a base substrate material made from an organic felt or fiberglass mat which serves as a matrix to support the other components and gives the product the required strength to withstand manufacturing, handling, installation, and service in the intended environment. An asphalt coating formulated for the particular service application is often applied to the base substrate material to provide the desired long-term ability to resist weathering and to provide stability under the anticipated temperature extremes. An outer layer of mineral granules is also commonly applied to the asphalt coating to form a surface exposed to the weather which shields the asphalt coating from the sun's rays, adds color to the final product and provides fire resistance.

Typically, shingles are installed on a roof deck such that the shingles are in a row from left to right and the lateral edges of the shingles in the row are contiguous with each other so as to abut each other, i.e. their lateral edges are adjacent to one another. Each row represents a course and the shingles are applied in overlapping courses on the roof deck, wherein the buttlap portion of a subsequent course is placed on the headlap portion of a previous course. The headlap portion of a conventional shingle is at least as wide as the buttlap portion of the shingle so that when the shingles are installed on a roof deck in overlapping courses, the entire buttlap portion of a subsequent course has headlap beneath it. If the shingle has tabs and openings in the buttlap portion, it is typical that at least two inches of the headlap portion of the subsequent course also has headlap from the previous course of shingles beneath it. This manner of installation prevents leakage to the roof deck where the lateral edges of the shingles abut each other and, in the case of tab shingles, where the openings in the buttlap are located.

In a typical prior art roofing system, contiguous shingles in a row abut each other at their lateral edges. Thus, when the shingles are exposed to wet weather, it is possible that leakage can occur at the region where the shingles abut. To prevent that, overlapping subsequent rows of shingles are installed in an offset pattern and each shingle's headlap portion is at least as wide as the buttlap portion. Thus, when the shingles are applied to the roof in a plurality of courses and the buttlap portion of a second course of shingles is laid over the headlap portion of a first row of shingles there is always headlap present underneath the regions where the contiguous shingles in a row abut. Any water penetrating the places where lateral edges of shingles abut contacts the headlap rather than the roof deck.

In a typical prior art roofing system using shingles with a tabbed buttlap portion, overlapping courses of shingles are installed such that they generally overlap each other to provide at least two inches of headlap across the entire headlap from the previous course of shingles underneath the headlap portion of the subsequent course. Such headlap overlap helps ensure that water contacting the headlap through the openings in the subsequent course does not contact the roof deck. Such headlap overlap is also usually required by building code.

As energy costs rise, the cost of petroleum-based materials, such as asphalt, and transportation expenses often rise as well. The amount of material employed in a shingle can contribute to costs of the shingle and the overall weight of the shingle, which also affects transportation costs. Certain installation requirements, such as a two inch headlap overlap for single layer shingles with a tabbed buttlap portion, constrain the possible dimensions for a shingle. Decreasing the amount of asphalt, substrate, and other materials required to make a shingle while maintaining the equivalent performance and coverage area, can reduce both material costs and transportation expenses to deliver such shingles.

Various shingles have employed, for aesthetic purposes, non-straight edge contours. U.S. Pat. No. 1,345,627 describes single layer roofing shingles to be arranged in overlapping courses. The shingle may have non-straight longitudinal edge contours, which shadow each other on either side of the shingle such that the width of the shingle is constant across the length of the shingle. The contour of the shingle, along with other features, operates to optically simulate various appearances including curved tiles.

U.S. Pat. No. 2,272,032 describes single layer asphalt roofing shingles with varying cross-sectional thickness to be arranged in offset overlapping courses. The shingle has longitudinal zigzag edge contours, which shadow each other on either side of the shingle such that the width of the shingle is constant across the length of the shingle. When the courses are installed, the thicker portions of a subsequent shingle "nest" in the thinner portions of the previously installed shingle to provide the protection qualities of more heavily coated roofing material.

U.S. Pat. No. 4,274,243 describes a laminated asphalt roofing shingle to be arranged in overlapping courses to optically simulate tiles. The shingle has a headlap portion with a generally straight edge and a butt portion with a generally continuously curving sinuous butt edge and an underlay portion with a matching generally continuously curving sinuous butt edge.

U.S. Pat. No. 4,333,279 describes strip or tabbed single layer asphalt shingles. The shingles have a headlap portion with a generally straight edge and a butt portion with a jagged, nonuniform butt edge.

U.S. Pat. No. 5,939,169 describes a composite shingle with a headlap portion, a buttlap portion that is divided into uniformly spaced apart tabs with curved or straight bottom edges or crimped corners, and an elongated backup strip that underlays the buttlap portion and conforms in outline to the bottom edge of the tabs and extends below the tabs at a distance equal to the spaces between the tabs so as to form a uniform border around the tabs.

U.S. Pat. No. 6,058,670 describes a laminated shingle with a headlap portion, a buttlap portion that is divided into uniformly spaced apart tabs with curved or straight bottom edges or crimped corners, and an elongated top strip that overlays the headlap portion and has a lower edge that duplicates or mirrors the sequence of the lower edge of the tab so as to allow a uniform strip border surrounding each tab upon installation.

U.S. Pat. No. 6,698,151 describes a laminated asphalt roofing shingle to be arranged in overlapping courses to simulate tiles. The shingle has a headlap portion with a generally straight contour and a buttlap portion with tabs. The tabs and openings between the tabs may have generally curved bottom edges. The buttlap portion also includes an underlay portion, which may have generally curved edges that may be coextensive with the curved bottom edges of the tabs.

Each of the above-referenced patents is incorporated herein by reference for all purposes within this application.

SUMMARY OF THE INVENTION

In accordance with the present invention, a roofing system is provided having a multiplicity of courses of tabbed roofing shingles wherein the shingles have non-straight longitudinal edges on either side of the shingle such that the width of the shingle varies across the length of the shingle.

The shingles of the present invention are single layer and have a maximum width (w) and a length (l), as illustrated in FIG. 2. The shingles further comprise a headlap portion and a buttlap portion, each having a non-straight longitudinal edge contour, as illustrated in FIGS. 2 and 9. The non-straight longitudinal edges comprise peaks and valleys with the distance between a peak and valley defining the edge magnitude 20 of the non-straight longitudinal edge, as illustrated in FIG. 2. The buttlap portion extends from the headlap portion and comprises tabs separated by openings, as illustrated in FIG. 2 featuring tabs 15 and openings 16.

When the shingles of the present invention are installed on a roof deck, a portion of the headlap portion of a shingle in a subsequently installed course overlaps a portion of the headlap portion of a shingle in a previously installed course to provide a headlap overlap region. The width dimension of the headlap overlap region varies due to the non-straight longitudinal edge of the previously installed shingle. In a preferred embodiment, the shingles are installed such that the maximum headlap overlap dimension is beneath the headlap portion of the subsequently installed shingle laterally proximate the openings in the buttlap portion of the shingle, as illustrated in FIG. 4, featuring maximum headlap overlap dimension 41.

The width dimensions of the shingles operate to provide sufficient headlap overlap laterally proximate the openings in the buttlap portion of the subsequently installed shingle while reducing the material required to make the shingles by reducing the headlap overlap not laterally proximate the openings in the buttlap portion of the subsequently installed shingle.

Thus, in accordance with one aspect of the present invention, a roofing system is provided comprising roofing shingles having headlap portions with non-straight longitudinal edges and a buttlap portions with non-straight longitudinal edges. The roofing system comprises a plurality of courses. Each course is comprised of a plurality of shingles wherein the dimensions of the shingles operate to provide sufficient headlap overlap laterally proximate the openings in the buttlap portion of subsequently installed shingles while reducing the material required to make the shingle by minimizing the headlap overlap not laterally proximate the openings in the buttlap portion of subsequently installed shingles. The headlap overlap underneath the headlap portion of the subsequent course, illustrated e.g. by maximum headlap overlap dimension 41 in FIG. 4, laterally proximate the openings in the buttlap portion, defines a maximum headlap overlap dimension. In a preferred embodiment, the maximum headlap overlap dimension is about two inches.

In a further preferred embodiment, the non-straight longitudinal edges are sinuously curved, e.g., as illustrated in FIG. 2. In another preferred embodiment, the non-straight longitudinal edges are angular such that generally straight lines connect the peaks and valleys of the edge contour, e.g., as illustrated in FIG. 9. In another preferred embodiment, the contours of the non-straight longitudinal edges have the same uniform pattern. In another preferred embodiment, the uniform non-straight longitudinal edges do not shadow each other laterally across the shingle. In a particularly preferred embodiment, the uniform non-straight longitudinal edges of the shingle mirror each other laterally across the shingle such that the distance between a buttlap peak and a corresponding headlap peak located directly across said shingle from the buttlap peak defines a maximum width of the shingle. In another preferred embodiment, the uniform non-straight longitudinal edges of the shingle may be offset from each other such that they do not shadow each other or mirror each other laterally across the shingle. In a preferred embodiment, the edge magnitude 20, as illustrated in FIG. 2, is from about 1% to about 12.5% the maximum width of the shingle (w). In a particularly preferred embodiment, the edge magnitude 20 is about 2.1% the maximum width of the shingle (w).

In a further preferred embodiment, the amount of material required to make shingles from a sheet of roofing material is reduced by cutting the sheet of roofing material longitudinally along non-straight lines wherein the formed shingles have a cumulative maximum combined width that is greater than the width of the sheet of roofing material.

The shingles of the invention are improvements of roofing shingle materials known in the art, where the improvements include a headlap edge and the buttlap edge, which are generally non-straight and when installed on a roof deck the maximum headlap overlap dimension is beneath the headlap portion of the subsequently installed shingle laterally proximate the openings in the buttlap portion of the subsequently installed shingle.

DETAILED DESCRIPTION OF THE FIGURES

For a more complete understanding of the present invention, and the advantages thereof, reference is now made to the following descriptions taken in conjunction with the accompanying figures but which are not to be construed as limiting to the scope of the present invention as defined by the appended claims, in which:

DETAILED DESCRIPTION

The preferred embodiments of the present invention and its advantages are best understood by referring to FIGS. 1 through 9, like numerals being used for like and corresponding parts of the various drawings.

Figure 1:
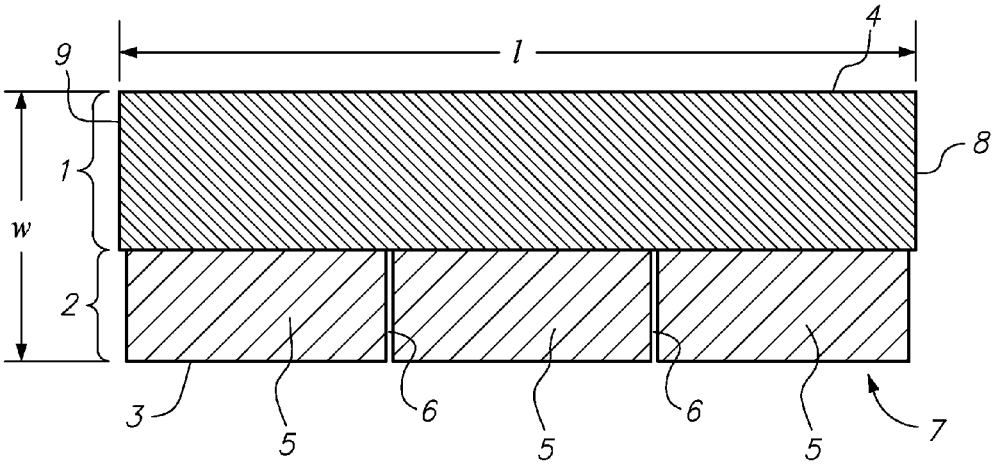
FIG. 1 PRIOR ART
FIG. 1 shows a prior art single layer roofing shingle.

FIG. 1 represents a typical prior art roofing shingle 7 comprising a headlap portion 1 and a buttlap portion 2. The buttlap portion 2 comprises tabs 5 separated by openings 6. The shingle has a width (w) and a length (l) and comprises generally straight longitudinal edges 3, 4 and generally straight lateral edges 8, 9.

A shingle 17 incorporating one embodiment of the present invention is shown in FIGS. 2, 4, 6, and 8. Shingle 17 preferably comprises a headlap portion 11 and a buttlap portion 12. The buttlap portion 12 comprises tabs 15 separated by openings 16. The shingles have a maximum width (w) and a length (l) and comprise a non-straight longitudinal headlap edge 14, a non-straight longitudinal buttlap edge 13 and generally straight lateral edges 18, 19. The non-straight longitudinal headlap edge 14 defines headlap peaks 23 extending away from the longitudinal center of the shingle and headlap valleys 24 extending toward the longitudinal center of the shingle. The non-straight longitudinal buttlap edge 13 defines buttlap peaks 21 extending away from the longitudinal center of the shingle and buttlap valleys 22 extending toward the longitudinal center of the shingle. The distance between buttlap peak 21 and buttlap valley 22, as well as the distance between headlap peak 23 and headlap valley 24, defines the edge magnitude 20. The tabs 15 have a uniform longitudinal tab dimension 204 and a maximum tab width dimension 202 located at the longitudinal center of the tab 15, or at half of the longitudinal tab dimension 203. The buttlap peaks 21 are approximately located at the longitudinal center of the tabs 15. The buttlap valleys 22 are approximately located at the openings 16. The openings 16 have a uniform longitudinal dimension 201. It should be understood that the shingle of the invention is not limited to shingles with three tabs in the buttlap portion, and that shingles with two or more tabs are contemplated. For example, shingles with two tabs through ten tabs utilizing the principles underlying the present invention are within the scope of the present invention.

Figure 3:
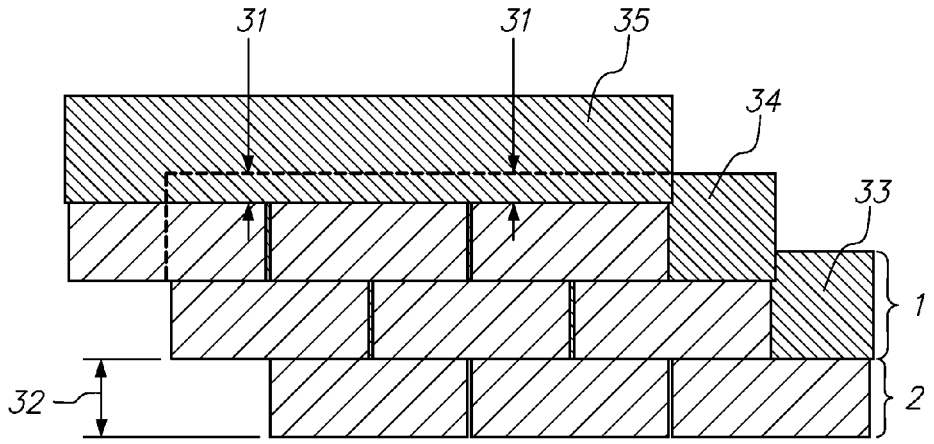
FIG. 3 PRIOR ART
FIG. 3 shows a roofing system incorporating the shingles of FIG. 1.

FIG. 3 shows a roofing system wherein prior art shingles 33, 34, 35 are installed as they would be applied to a roof deck. Part of the headlap portion 1 lies beneath part of the buttlap portion 2 of a subsequent course. The system is comprised of shingles installed as they would be in an offset manner in three separate courses. After a shingle 33 in a first course is installed, a shingle 34 in a subsequent course is applied to the roof deck such that the buttlap portion 2 of the subsequent shingle 34 overlaps the headlap portion 1 of the shingle 33 in the previous course. The buttlap portion 2 of each shingle is exposed to the weather defining a buttlap exposure dimension 32. A portion of the headlap portion 1 of a shingle from a subsequently installed course of shingles also overlaps at least a portion of the headlap portion 1 of a shingle from a previously installed course of shingles defining a continuous headlap overlap region 31 of uniform width across the shingle, as illustrated in FIG. 3 for the headlap overlap of shingles 34, 35.

Figure 4:
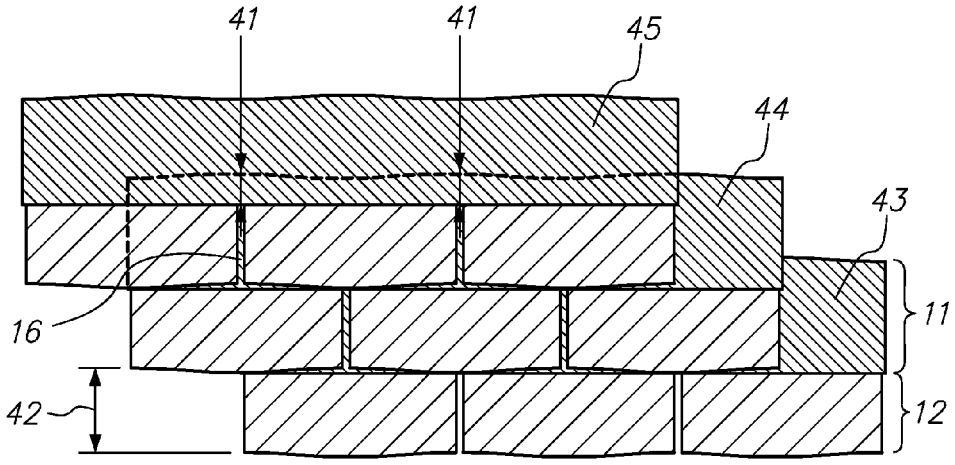
FIG. 4 shows an exemplary embodiment of a roofing system of the present invention incorporating the shingles of FIG. 2.

FIG. 4 shows a roofing system of the invention wherein shingles 43, 44, 45 of the invention are installed as they would be applied to a roof deck. A part of the headlap portion 11 lies beneath part of the buttlap portion 12. The system is comprised of shingles installed as they would be in an offset manner in three separate courses. After a shingle 43 in a first course is installed, a shingle 44 in a subsequent course is applied to the roof deck such that the buttlap portion 12 of the subsequent shingle 44 overlaps the headlap portion 11 of the shingle 43 in the previous course. The buttlap portion 12 of each shingle is exposed to the weather defining a buttlap exposure dimension 42, which is equivalent in width to the maximum tab width dimension 202 illustrated in FIG. 2. A portion of the headlap portion 11 of a shingle from a subsequently installed course of shingles also overlaps at least a portion of the headlap portion 11 of a shingle from a previously installed course of shingles defining a headlap overlap region having a maximum headlap overlap dimension 41, which is laterally proximate the openings 16 in the buttlap portion 12 of a shingle from a subsequently installed course of shingles, as illustrated in FIG. 4 for the headlap overlap of shingles 44, 45.

Figure 2:
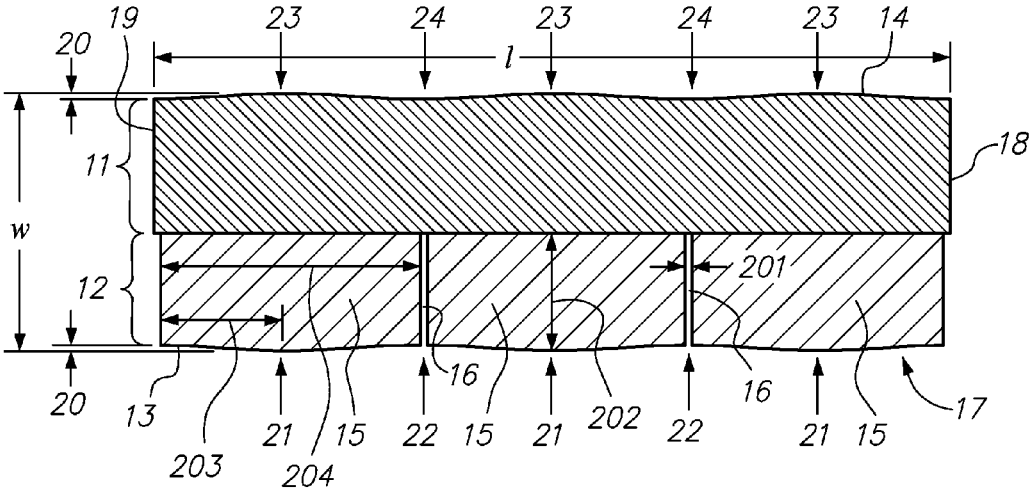
FIG. 2 shows an exemplary embodiment of a single layer roofing shingle of the present invention having a curved contour in the butt portion and a curved contour in the headlap portion.

Referring to FIG. 2, the exposed outer surface or weather surface, i.e., the buttlap portion 12 of shingle 17 of the invention, may be coated with various types of mineral granules to protect the asphalt coating, to add color to shingle 17 of the invention and to provide fire resistance. For some applications, ceramic-coated mineral granules may be disposed on the top surface of the buttlap portion 12. Also, a wide range of mineral colors from white and black to various shades of red, green, brown and any combination thereof may be used to provide a roof having the desired color for shingle 17 of the invention. In other embodiments, the entire outer surface of shingle 17 of the invention may be coated with any of the aforementioned coatings. In further embodiments, the headlap portion 11 of shingle 17 of the invention may be coated with coatings that contrast with coatings applied to the buttlap portion 12 of shingle 17 of the invention. The underside of shingle 17 of the invention may be coated with various inert minerals with sufficient consistency to seal the asphalt coating.

For one embodiment of the present invention, the shingle 17 may be formed from a fiberglass mat (not shown) with an asphalt coating on both sides of the mat, or a partial coating by coating the headlap portion only or the buttlap portion only. If desired, the present invention may also be used with shingles formed from organic felt or other types of base material, including but not limited to synthetic mats or synthetic glass/hybrid mats having an appropriate coating. Nonlimiting embodiments of coatings include asphalt and modified bituminous coatings based on atactic polypropylene (APP), styrene-butadiane-styrene (SBS), styrene-ethylene-butadiene-styrene (SEBS), amorphous polyalpha olefin (APAO), thermoplastic polyolefin (TPO), synthetic rubber or other asphaltic modifiers.

An important feature of the present invention includes providing a shingle with a non-straight longitudinal headlap edge and non-straight longitudinal buttlap edge. The dimensions of the inventive shingles operate to provide sufficient headlap overlap laterally proximate the openings in the buttlap portion of the subsequently installed shingle while reducing the material required to make the shingles. Such material reduction is accomplished by reducing the headlap overlap which is not laterally proximate the openings in the buttlap portion of the subsequently installed shingle. In a preferred embodiment, the non-straight longitudinal headlap edge and the non-straight longitudinal buttlap edge have the same uniform pattern and mirror each other laterally across the shingle, as illustrated in FIG. 2 where headlap peak 23 mirrors buttlap peak 21 and headlap valley 24 mirrors buttlap valley 22. For a particularly preferred embodiment of the present invention shown in FIGS. 2, 4, 6, and 8, the edge magnitude 20 is 0.25 inches or 2.1% of the maximum width (w) of the shingle. The maximum width (w) of the shingle is about twelve inches and the shingle length (l) is about 36 inches. The butt portion 12 comprises three tabs 15 with a maximum tab width dimension 202 of about five inches, and a longitudinal tab dimension 204 of about 11.75 inches, and spaced apart by openings 16 having a longitudinal opening dimension 201 of about 0.25 inches. The non-straight longitudinal headlap edge 14 and non-straight longitudinal buttlap edge 13 have uniform sinuously curved contours. It should be understood that the above examples are illustrative, and that patterns and dimensions other than those described above can be used while utilizing the principles underlying the present invention.

Figure 9:
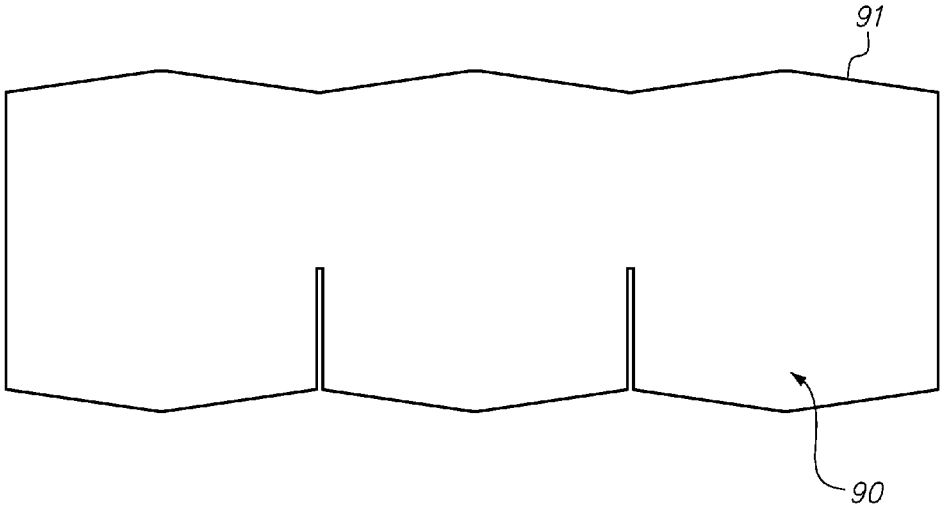
FIG. 9 shows an exemplary embodiment of a single layer shingle of the present invention having non-straight longitudinal edge contours that are angular such that generally straight lines connect peaks and valleys in the edge contours.

Depending on the desired application and appearance of each shingle 17, the edge magnitude 20 may be from about 0.125 inches to about 1.5 inches, or from about 1% to about 12.5% of the maximum width of the shingle (w), as long as the shingle when applied to a roof deck in an overlapping roofing system maintains a maximum headlap overlap dimension 41 of about two inches, which is laterally proximate the openings in the buttlap portion of the subsequently installed shingle. In a particularly preferred embodiment the maximum headlap overlap dimension is about two inches or the minimum headlap dimension overlap required by the applicable building code. In a preferred embodiment, the overlapping subsequently installed courses of shingles are installed in an offset pattern. The non-straight longitudinal headlap edge 14 and non-straight longitudinal buttlap edge 13 may have a uniform angular or zigzag pattern (see FIG. 9 showing shingle 90 of the invention featuring longitudinal edges with a zigzag pattern 91), as long as the pattern of the headlap edge 14 does not shadow the pattern of the buttlap edge 13. In a particularly preferred embodiment, the non-straight longitudinal headlap edge 14 is the mirror image of the non-straight longitudinal buttlap edge 13 such that headlap peaks 23 correspond to buttlap peaks 21 on the other side of the shingle 17, and headlap valleys 24 correspond to buttlap valleys 22 on the other side of the shingle 17.

In another embodiment, the shingle dimensions have a maximum width (w) such that when installed in an overlapping roofing system the maximum width (w) of the preceding shingle is located underneath the openings 16 in the buttlap portion 12 of the subsequent shingle.

Figure 5:
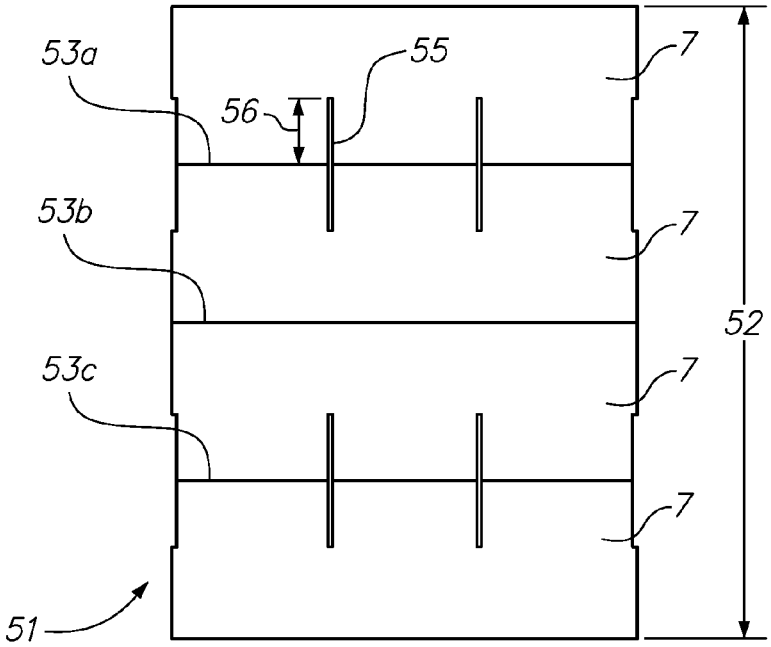
FIG. 5 PRIOR ART
FIG. 5 shows a sheet of roofing material from which components for four single layer shingles of FIG. 1 may be obtained.

FIG. 5 shows a sheet of roofing material 51 with a width 52 from which four prior art shingles 7 are made by cutting the roofing material 51 longitudinally along generally straight lines 53*a*, 53*b*, 53*c*. The cuts form the generally straight longitudinal edges 3, 4 of the prior art shingle 7, as illustrated in FIG. 1. Slits 55 of a width 56 are cut into the roofing material 51 to form the openings 6 that separate the tabs 5 in the buttlap portion 2 of the prior art shingle 7, as illustrated in FIG. 1.

Figure 6:
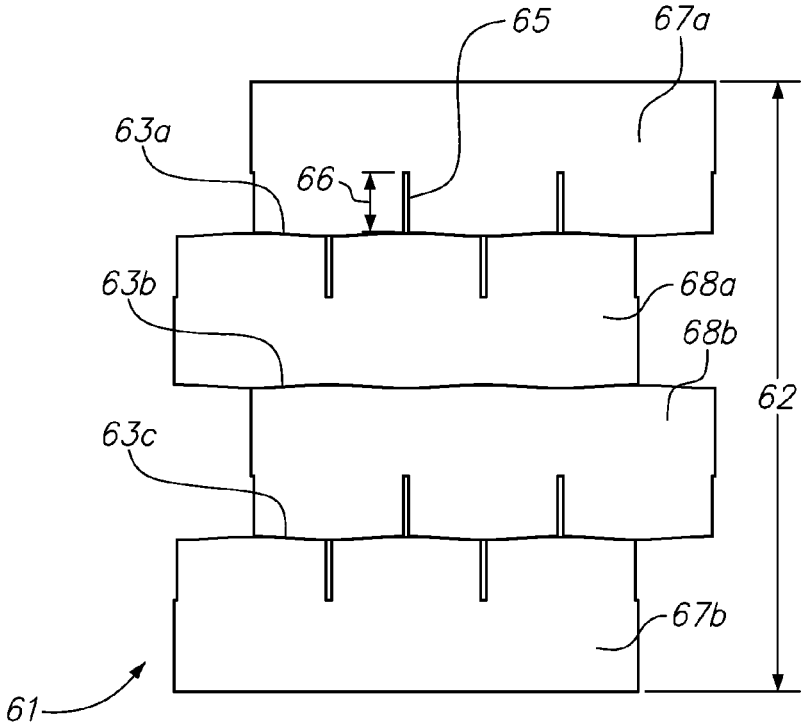
FIG. 6 shows an exemplary sheet of roofing material of the present invention from which components for two single layer shingles of FIG. 2 may be obtained, and two shingles with generally straight longitudinal headlap edges may be obtained.

FIG. 6 shows a sheet of roofing material 61 of the invention with a width 62 from which two shingles 68*a* and 68*b* of the invention are made by cutting the roofing material 61 longitudinally along non-straight lines 63*a*, 63*b*, 63*c*. The cuts form the non-straight longitudinal headlap edge 14 and the non-straight longitudinal buttlap edge 13 of the shingle 17 of the invention, as illustrated in FIG. 2. Slits 65 of a width 66 are cut into the roofing material 61 to form the openings 16 that separate the tabs 15 in the buttlap portion 12 of the shingle 17 of the invention, as illustrated in FIG. 2. Shingles 68*a* and 68*b* are equivalent to shingle 17 of the invention, as illustrated in FIG. 2, and shingles 67*a* and 67*b* each form a shingle having a non-straight longitudinal buttlap edge and a generally straight longitudinal headlap edge. All of which may be used as shingles in the roofing system of the invention.

Figure 7:
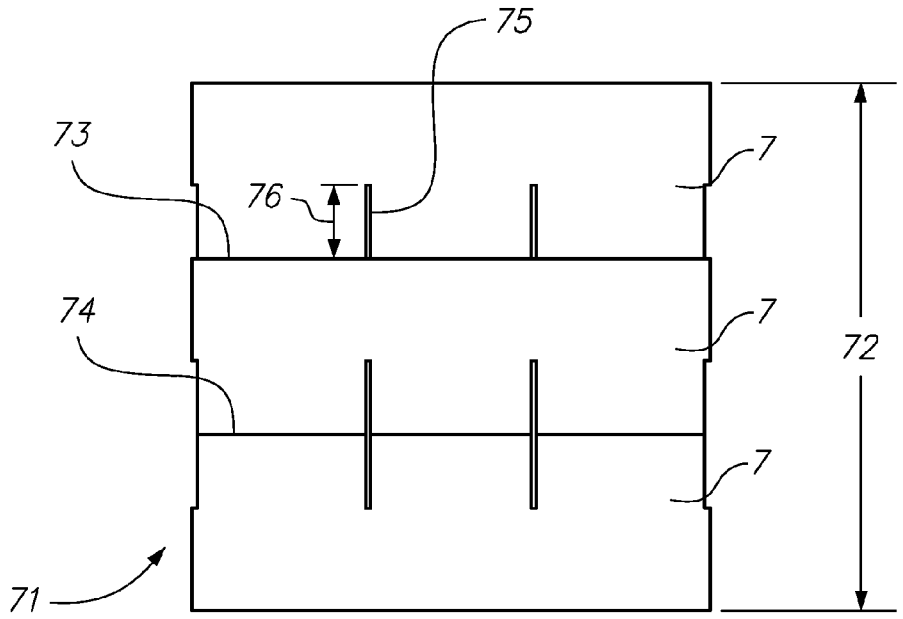
FIG. 7 PRIOR ART
FIG. 7 shows a sheet of roofing material from which components for three single layer shingles of FIG. 1 may be obtained.

FIG. 7 shows a sheet of roofing material 71 with a width 72 from which three prior art shingles 7 are made by cutting the roofing material 71 longitudinally along generally straight lines 73, 74. The cuts form the generally straight longitudinal edges 3, 4 of the prior art shingle 7, as illustrated in FIG. 1. Slits 75 of a width 76 are cut into the roofing material 71 to form the openings 6 that separate the tabs 5 in the buttlap portion 2 of the prior art shingle 7, as illustrated in FIG. 1.

Figure 8:
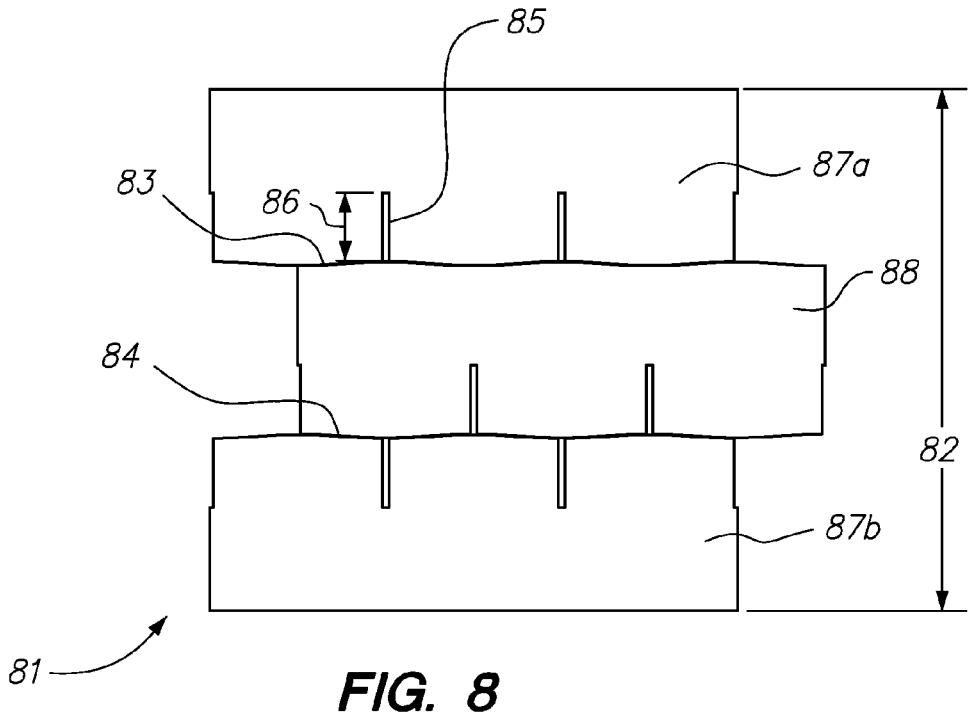
FIG. 8 shows an exemplary sheet of roofing material of the present invention from which components for one single layer shingle of FIG. 2 may be obtained, and two shingles with generally straight longitudinal headlap edges may be obtained.

FIG. 8 shows a sheet of roofing material 81 of the invention with a width 82 from which one shingle 88 of the invention is made by cutting the roofing material 81 longitudinally along non-straight lines 83, 84. The cuts form the non-straight longitudinal headlap edge 14 and the non-straight longitudinal buttlap edge 13 of the shingle 17 of the invention, as illustrated in FIG. 2. Slits 85 of a width 86 are cut into the roofing material 81 to form the openings 16 that separate the tabs 15 in the buttlap portion 12 of the shingle 17 of the invention, as illustrated in FIG. 2. Shingle 88 is equivalent to shingle 17 of the invention, as illustrated in FIG. 2, and shingles 87*a*, 87*b* each form a shingle having a non-straight longitudinal buttlap edge and a generally straight longitudinal headlap edge. All of which may be used as shingles in the roofing system of the invention.

An important feature of the invention is reducing the amount of material required to make shingles from a sheet of roofing material by cutting the sheet of roofing material with non-straight longitudinal cuts wherein the formed shingles have a cumulative maximum combined width that is greater than the width of the sheet of roofing material. The width 62, 82 of the roofing material 61, 81 required to make shingles in the manner of the invention by cutting the roofing material 61, 81 in non-straight longitudinal lines 63*a*, 63*b*, 63*c*, 83, 84 is less than the width 52, 72 of the roofing material 51, 71 required to make prior art shingle 7. For one embodiment of the present invention, the width 62 of roofing material 61 required to make four shingles with at least a portion of each shingle having a width of about twelve inches is about 47.25 inches. The width 52 of roofing material 51 required to make four prior art shingles 7 with a width (w) of twelve inches is 48 inches. For another embodiment of the present invention, the width 82 of roofing material 81 required to make three shingles with at least a portion of each shingle having width of about twelve inches is about 35.5 inches. Forming the prior art shingle 7 according to conventional methods requires a wider sheet of roofing material. The width 72 of roofing material 71 required to make three prior art shingles 7 with a width (w) of twelve inches is 36 inches.

The non-straight longitudinal edges of the shingle of the present invention are desirable because they allow for a reduction in the weight of the shingles of the invention, as well as a reduction in the amount and cost of the materials used to make the shingles and the expense to transport them. A roofing system of the invention using the shingle 17 or 90 of the present invention with non-straight longitudinal edges covers the same surface area of roof deck as a roofing system using prior art shingles with generally straight longitudinal edges while using less material because the dimensions of the shingle 17 or 90 of the invention maintain a maximum headlap overlap dimension 41 of about two inches, or the minimum headlap overlap required by the applicable building code, by dispensing with extra material otherwise required to construct a shingle with generally straight edges and larger surface area. In a particularly preferred embodiment, about 50% of the shingles used in a roofing system of the present invention comprises shingle 17 or 90 of the invention. In another particularly preferred embodiment, about 33% of the shingles used in a roofing system of the present invention comprises shingle 17 or 90 of the invention.

Although the present invention and its advantages have been described in detail, it should be understood that various changes, substitutions and alterations can be made therein without departing from the spirit and scope of the invention as defined by the appended claims.

What is claimed is:

1. A method for making roofing shingles comprising:

providing a roofing material having a width less than 48 inches;

cutting the roofing material longitudinally along three non-straight lines to form four shingles, wherein at least a portion of each said shingle has a width of about twelve inches and wherein two of said four shingles have a headlap portion including a non-straight longitudinal edge along a side of said shingles defining headlap peaks that extend away from a longitudinal center of said shingles and headlap valleys that extend toward the longitudinal center of said shingles:

and all four shingles have a buttlap portion including a plurality of tabs extending from said headlap portion, said tabs spaced apart to define a plurality of openings between said tabs;

wherein said buttlap portion further includes a non-straight longitudinal edge along a side of said shingles defining buttlap peaks that extend away from the longitudinal center of said shingles and buttlap valleys that extend toward the longitudinal center of said shingles.

2. The method according to claim 1, wherein the width of said roofing material is from about 43.5 inches to about 47.625 inches.

3. A method for making roofing shingles comprising:

providing a roofing material having a width less than 36 inches;

cutting the roofing material longitudinally along two non-straight lines to form three shingles, wherein at least a portion of each of said shingle has a width of about twelve inches and wherein one of said three shingles has a headlap portion including a non-straight longitudinal edge along a side of said shingles defining headlap peaks that extend away from a longitudinal center of said shingles and headlap valleys that extend toward the longitudinal center of said shingles;

and all three shingles have a buttlap portion including a plurality of tabs extending from said headlap portion, said tabs spaced apart to define a plurality of openings between said tabs;

wherein said buttlap portion further includes a non-straight longitudinal edge along a side of said shingles defining buttlap peaks that extend away from the longitudinal center of said shingles and buttlap valleys that extend toward the longitudinal center of said shingles.

4. The method according to claim 3, wherein the width of said roofing material is from about 33 inches to about 35.75 inches.

* * * * *